United States Patent [19]

Almeras

[11] Patent Number: 4,883,213

[45] Date of Patent: Nov. 28, 1989

[54] EXPLOSIVE DIVING TOOL APPARATUS WITH IMPROVED EXTRACTOR

[75] Inventor: Roland Almeras, Tournon, France

[73] Assignee: Societe de Prospection et d'Inventions Techniques (S.P.I.T.), Bourg les Valence, France

[21] Appl. No.: 253,543

[22] Filed: Oct. 5, 1988

[30] Foreign Application Priority Data

Oct. 28, 1987 [FR] France ..... 87 14908

[51] Int. Cl.[4] ..... B25C 1/14

[52] U.S. Cl. ..... 227/10

[58] Field of Search ..... 227/9–11; 42/25

[56] References Cited

U.S. PATENT DOCUMENTS 1,041,410 10/1912 Benet et al. ..... 42/25
2,624,969 1/1953 Ruger ..... 42/25
2,807,902 10/1957 Kopf ..... 42/25
3,860,161 1/1975 Engstrom et al. ..... 227/10

*Primary Examiner*—Donald R. Schran
*Assistant Examiner*—James L. Wolfe
*Attorney, Agent, or Firm*—Schwartz & Weinrieb

[57] ABSTRACT

An explosive tool driving apparatus is provided having an improved extractor mounted upon its barrel holder, and the claw of which is meant to retain the case of a propulsive charge during opening of the apparatus. A groove for passage of the claw of the extractor is formed within the barrel of the apparatus. In the firing position, the claw is disposed in front of an abutment shoulder for the collar of the case, so as to provide an initial axial clearance, the extractor is freely movable in translation between two axial stops and, during opening, is moved forwardly by the means of collar of the case the improvement thereby avoiding the hard point during opening of the apparatus

11 Claims, 3 Drawing Sheets

EXPLOSIVE DIVING TOOL APPARATUS WITH IMPROVED EXTRACTOR

FIELD OF THE INVENTION

The present invention relates to a fastener driving apparatus, including a barrel holder, a barrel mounted for sliding within the barrel holder, in the rear of which is formed a housing for receiving a propulsive charge case having a collar, and adapted for receiving a fixing plug or fastener intended to be propelled under the action of the combustion gases of the charge, an extractor with an extraction claw for retaining the case during opening of the apparatus, mounted upon the barrel holder so as to be pushed towards the axis of the barrel holder by resilient return means and a groove for passage of the extraction claw being formed within an axial plane of the barrel, with a rearwardly inclined ramp upon of the barrel.

BACKGROUND OF THE INVENTION

Such an apparatus is already known, more particularly from the document FR-A-1 083 665. This apparatus has an extractor with, in particular, two features. In the firing position of the apparatus, the extraction claw is in contact with the collar of the charge; the extractor is mounted for pivoting about a fixed axis.

If, at the time of firing, the case of the charge swells too much, it may become jammed within the barrel housing. In this case, upon opening of the apparatus, the claw of the extractor remains in abutment against the collar of the case of the used charge which has unfortunately become interlocked with the barrel and, since the extractor is fixed to the barrel holder, the operator cannot open the apparatus or can only open the apparatus with substantial difficulty. This is the "hard point" upon the barrel at the time of opening.

With document US-A-2 807 902, another sealing apparatus is known, of which the extractor, mounted upon the breech, is pushed toward the axis of the barrel by means of a ring and which can freely move in translation between two front and rear stops in order to, upon opening of the apparatus, be moved forwardly. As a result of this movement of the extractor, ejection of the case, during opening of the apparatus, is already slightly made easier. However, the hard point is not totally eliminated.

OBJECT OF THE INVENTION

The object of the present invention aims at eliminating this hard point.

SUMMARY OF THE INVENTION

For this, the instant invention relates to an apparatus of the above mentioned type, characterized in that the extractor is mounted freely mobile in translation upon the barrel holder, with an axial clearance (J) defined between a leading edge portion of the extractor and the forward one of two radial rear and front stops formed by means of a lateral notch provided within the barrel holder, the extractor being adapted so that, during opening of the apparatus, the extractor is moved forwardly by means of the collar of the case of the charge wherein the housing has an abutment shoulder for the collar of the case and, in the firing position, the extraction claw of the extractor is disposed in front of this abutment shoulder so as to provide an axial clearance (t) between the shoulder and the claw.

Thus, with the invention, the extraction claw, during opening of the apparatus, is not only driven along a small distance before it suddenly retains, under the shock effect against the front stop, the case of the charge, but an initial clearance is also created between the claw of the extractor and the collar of the case which, during opening of the apparatus, is added to the possible axial stroke of the extractor from the rear stop to the front stop, so as to increase the shock effect and thereby avoiding the hard point.

In the preferred embodiment of the invention, the extractor includes a front holding flange adapted for movement between the stops of the notch and around which it can pivot under the action of the ramp and return means.

Preferably the extractor is adapted so that, in the firing position, its extraction claw is in contact with the ramp of the passage groove formed within the barrel and is raised against the action of the return means so as to provide a radial clearance (r) between a nose portion of the extractor and a bearing surface provided upon the barrel holder and against which the nose portion can come into abutment.

Thus, in the apparatus of the invention, another radial clearance is created allowing the extraction claw, during ejection and under the action of the return means, to move towards the axis of the barrel, to remain in contact with the case of the charge and consequently to prevent it from being retained within the housing in the case where the position of the apparatus would otherwise have caused it to be retained.

BRIEF DESCRIPTION OF THE DRAWINGS

The invention will be better understood from the following description of the preferred embodiments of the apparatus of the invention, with reference to the accompanying drawings in which.

DETAILED DESCRIPTION OF THE INVENTION

Figure 4:
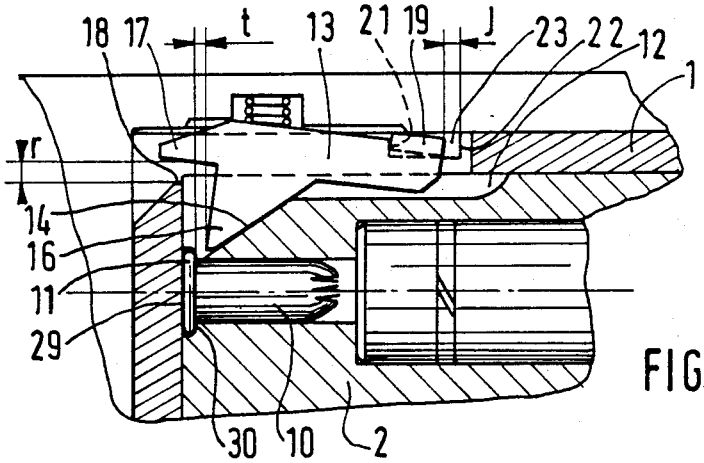
FIG. 4 shows on a larger scale a vertical axial sectional view of the apparatus in the closed position.
Figure 6:
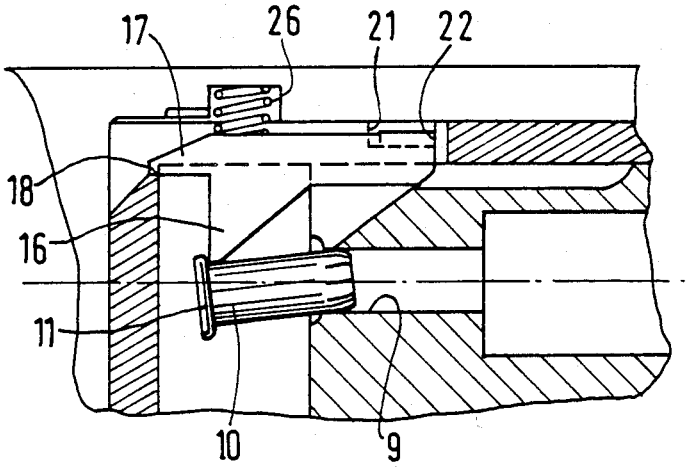
FIG. 6 shows the apparatus of FIGS. 4 and 5 practically at the end of extraction.
Figure 7:
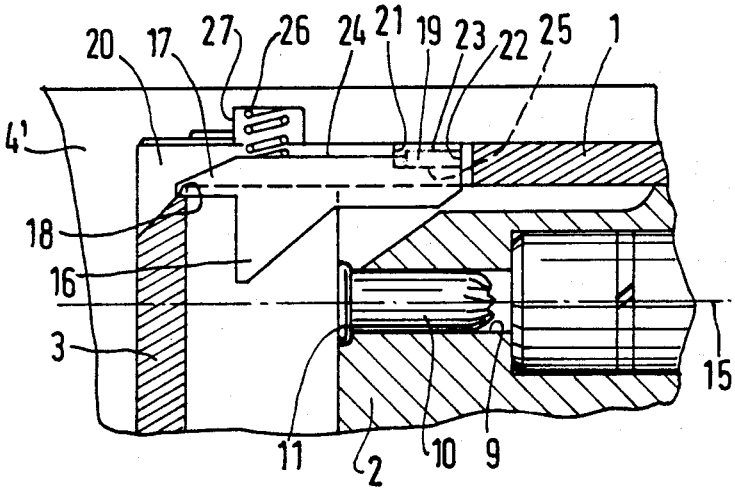
FIG. 7 shows the apparatus of FIGS. 4 to 6 before closure thereof.

The apparatus shown in the FIGS. includes a barrel holder 1 and a barrel 2 mounted for sliding within the barrel holder having an axis 15. The barrel holder is mounted within a grip 4, here formed of two half shells 4', 4''. The rear part 3 of the barrel holder is adapted so as to form a breech for the striker 6. The barrel receives a piston 7 intended to propel a fixing plug or fastener under the action of the combustion gases of a powder charge 8. Case 10 of charge 8 is housed within a reception housing or bore 9 formed at the rear of barrel 2 as best seen in FIGS. 6 and 7. Housing 9 has a rear portion of slightly larger diameter for receiving the base collar 11 of the case and thus to make possible correct closure of the apparatus, the rear portion and the front portion of reduced diameter forming an abutment shoulder 30 for the collar as best seen in FIG. 4.

Figure 2:
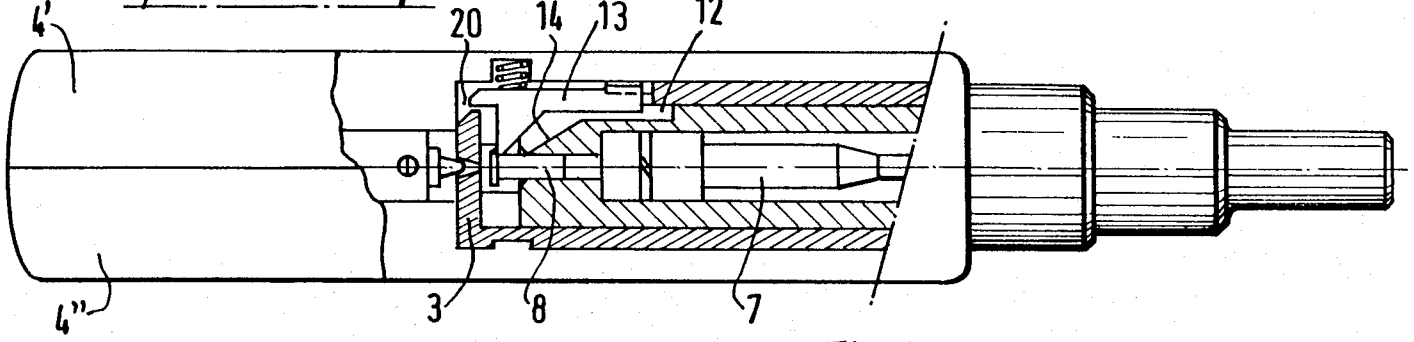
FIG. 2 is a horizontal axial sectional view of the apparatus of FIG. 1, after firing and during extraction of the case of the charge.

In an axial plane of barrel 2, and at the rear thereof, a groove 12 has been formed for allowing extractor 13 to be accommodted therein as best seen in FIG. 2. Groove 12 has a ramp 14 inclined rearwardly of the apparatus with respect to axis 15 of the barrel. Groove 12 opens into the zone of the reception housing 9 of reduced diameter receiving the charge case 10, in front of the rear widened zone receiving the collar of the case.

Figure 3:
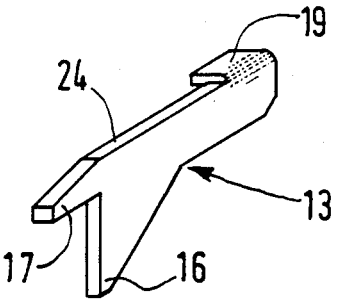
FIG. 3 shows a perspective view of the extractor of the apparatus of the invention.

The extractor 13 (FIG. 3), of a general flat and longitudinal shape, has a tapered extraction claw 16 intended to cooperate, through groove 12, with case 10 and the collar 11 of the charge case, an abutment nose 17 intended to engage a bearing surface 18 of the barrel holder, disposed parallel to axis 15 and extending perpendicularly to the general plane of the extractor holding flange 19.

Extractor 13 is here formed from a cut out metal sheet, flange 19 being obtained by bending the same at 90°. The extractor extends substantially parallel to the axis 15 of the apparatus, with the abutment nose 17 at the rear, the holding flange 19 at the front and, projecting between the two, the extraction claw 16 but which is disposed closer to the abutment nose.

Extractor 13 is mounted for free axial translation in an axial groove 20 of the barrel holder, as best seen in FIG. 7, its translational movement being however limited by means of two rear 21 and front 22 shoulders formed by means of a lateral notch 23 provided within the barrel holder and within which the holding flange 19 extends which may then move between these two shoulders.

Extractor 13 is also mounted relatively free for radial or lateral movement, between the wall of the half shell 4' of the grip, by means of its external edge 24, on the one hand, and the land 25 of notch 23, as best seen in FIG. 7, which is engaged by means of the internal face of flange 19, and the bearing surface 18 of the barrel holder, which is engaged by means ofthe internal face of the abutment nose 17, on the other hand. More precisely, the extractor 13 is mounted practically for pivoting about its flange 19 within notch 23, under the action of a compression spring 26 bearing against the external edge 24 and the bottom of a recess 27 formed within the half shell 4' of the grip, also as best seen in FIG. 7.

In the open position of the apparatus, the extraction claw 16 is disposed rearwardly of the housing receiving charge 10, the edge 24 of extractor 13 is disposed substantially parallel to axis 15, and nose 17 is urged into abutment against the bearing surface 18 of the barrel holder by means of spring 26.

Figure 1:
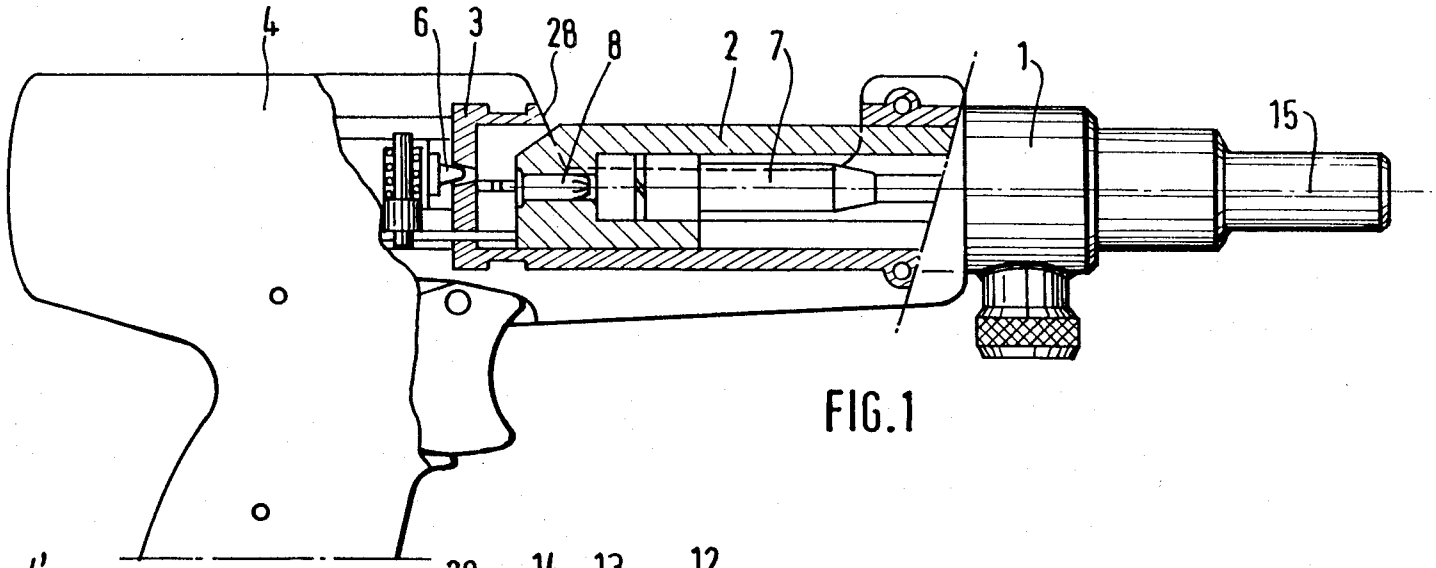
FIG. 1 is a vertical axial sectional view of the apparatus as loaded and before cocking.

When the apparatus is closed after fitting a charge 8 within the housing 9 of barrel 2 through means of the loading aperture 28 formed within grip 4, as best seen in FIG. 1, the collar 11 of the case 10 passes behind the extraction claw 16. In the closed and cocked position of the apparatus, the rear face of case 10 bears against the front face 29 of breech 3, as best seen in FIG. 4 ramp 14 having first of all, by means of claw 16, pushed the extractor 13, rearwardly, with its flange 19 in abutment against the rear shoulder 21 of notch 23, before retracting it and causing it to pivot, still by means of its claw 16, against the action of spring 26. In this closed position (FIG. 4), there exists an axial clearance J between flange 19 and the front shoulder 22 of notch 23; there also exists an axial play t between the tip of the extraction claw 16 and the front surface of collar 11 of the case 10.

In this closed or firing position of the apparatus, the extraction claw 16 is disposed in front of the abutment shoulder 30 accommodating collar 11, of housing 9 receiving charge 8, and is in engagement with ramp 14 of groove 12 in the pivoted position.

In this closed position, and because of the pivoting of extractor 13, there exists a radial clearance r between the abutment nose 17 and the bearing surface 18 of the barrel holder.

Figure 5:
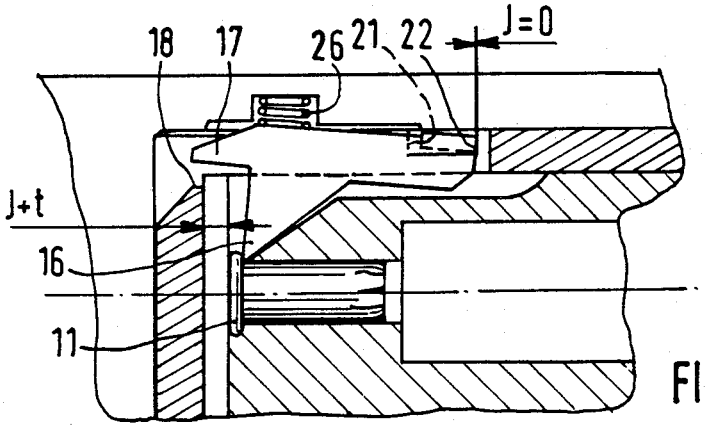
FIG. 5 shows the apparatus of FIG. 4, after firing, at the beginning of extraction.

After firing, and during opening of the apparatus when the barrel is driven forwards in the barrel holder for ejecting the case, the barrel 2 moves forwards and the extraction claw 16, under the action of spring 26, slides along the inclined ramp 14 so as to come into contact with collar 11 and eliminate the clearance T (FIG. 5).

With barrel 2, and with it case 10, continuing its forward movement, it drives the extractor 13 forwards until its flange 19 engages with the front shoulder 22 of notch 23, which eliminates the clearance J.

When the barrel has moved forwardly by means of the distance t+J, and since the extractor 13 can no longer move, under the shock effect, against the front stop 22, the extraction claw 16 suddenly retains the case by means of its collar 11, whereas barrel 2 continues its stroke. Under the action of spring 26, nose 17 abuts against the bearing surface 18 of the barrel holder, which eliminates out the clearance r and the extraction claw 16 thus remains in contact with case 10 (FIG. 6). In this position of the extractor 13, case 10, inclined rearwardly with respect to axis 15 by means of claw 16, is almost entirely removed from housing 9. It completely removed under the action of the continued forward movement of barrel 2.

By way of example, in the rest position of extractor 13 (FIGS. 6, 7), the distance from the tip of the extraction claw 16 to axis 15 is substantially equal to a fifth of the diameter of collar 11, that is approximately 1.5 mm, the axial clearances being possibly equal, J from about 1 to 2.5 mm and t from about 1 to 2 mm.

Obvious, many modifications and variations of the present invention are possible in light of the above teachings. It is therefore to be understood that within the scope of the appended claims, the present invention may be practiced otherwise than as specifically described herein.

I claim:

1. Explosive tool driving apparatus, comprising:

a barrel holder;

a barrel movably disposed within said barrel holder between a firing position and an open position;

a propulsive charge case containing a propulsive charge, for generating propulsive gases for propelling a fastener to be driven into a workpiece, and having a collar formed upon a rear portion thereof;

bore means defined within a rear portion of said barrel for housing said propulsive charge case;

notch means defined within said barrel holder for defining first rearward and second forward stops; and an extractor movably mounted upon said barrel holder between first rearward apparatus-firing and second forward apparatus-opening positions, and having engagement means disposed within said notch means of said barrel holder so as to be interposed between said first and second stops, and an extraction claw for engaging said collar of said propulsive charge case during opening of said apparatus so as to remove said propulsive charge case from said housing bore means of said barrel, wherein when said apparatus is disposed at said firing position, said extractor is disposed at said first rearward position at which said engagement means of said extractor, disposed within said notch means of said barrel holder, is engaged with said first rearward stop such that a front end portion of said extractor engagement means is spaced from said second forward stop of said notch means so as to define an axial distance (J) therebetween while said extraction claw is spaced from said collar of said propulsive charge case so as to define an axial distance (t) therebetween, while when said barrel is moved toward said open position, said collar of said propulsive charge case engages said extraction claw of said extractor so as to move said extractor forwardly whereby said engagement means of said extractor engages said second forward stop of said notch means so as to prevent further forward movement of said extractor and said propulsive charge case whereby said propulsive charge case is extracted from said bore means of said barrel as said barrel continues to move forwardly toward said open position.

2. The apparatus as set forth in claim 1, wherein:

said extraction claw of said extractor has a substantially right triangular configuration;

said barrel is provided with an inclined ramp portion upon which a hypotenuse portion of said substantially right triangular extraction claw is seated when said barrel is disposed at said firing position; and spring biasing means are provided for biasing said extractor toward said barrel so as to seat said extraction claw of said extractor upon said inclined ramp portion of said barrel.

3. The apparatus as set forth in claim 2, further comprising:

housing means for housing said barrel holder; and recess means defined within said housing means for accommodating said spring biasing means such that said spring biasing means is interposed between said housing means and said extractor.

4. The apparatus as set forth in claim 2, further comprising:

a nose portion defined upon an end of said extractor which is disposed opposite an end upon which said engagement means is defined; and bearing support means defined upon said barrel holder for supporting said nose portion of said extractor when said extractor is moved to said second position as said barrel is moved toward said open position.

5. Apparatus according to claim 4, wherein:

in the firing position, said extraction claw is disposed in contact with said ramp portion of said barrel and is raised against the biasing force of said spring biasing means so as to provide a radial clearance (r) between said nose portion of said extractor and said bearing support means formed upon said barrel holder and against which said nose portion can come into abutment.

6. The apparatus as set forth in claim 2, further comprising:

pivot means defined between said extractor engagement means and said notch means of said barrel holder about which said extractor pivots against said spring biasing means when said barrel is disposed at said firing position, and about which said extractor pivots under the biasing force of said spring biasing means when said barrel is moved toward said open position.

7. The apparatus as set forth in claim 2, further comprising:

pivot means defined between said engagement means of said extractor and said notch means of said barrel holder about which said extractor pivots against said spring biasing means in response to contact between said ramp portion of said barrel and said hypotenuse portion of said extraction claw when said barrel is disposed at said firing position, and about which said extractor pivots under the biasing force of said spring biasing means when said barrel is moved toward said open position.

8. The apparatus as set forth in claim 1, further comprising:

abutment shoulder means defined within an open end portion of said barrel bore means for accommodating said collar of said propulsive charge case.

9. The apparatus as set forth in claim 1, further cmprising:

first axially extending groove means defined within said barrel holder for accommodating said movement of said extractor between said first and second positions; and second axially extending groove means defined within said barrel for accommmodating said movement of said extractor between said first and second positions.

10. The apparatus as set forth in claim 1, further comprising:

a nose portion defined upon an end of said extractor which is disposed opposite an end upon which said engagement means is defined; and bearing support means defined upon said barrel holder for supporting said nose portion of said extractor when said extractor is moved to said second position as said barrel is moved toward said open position.

11. The apparatus according to claim 1, wherein the engagement means of said extractor comprises a flange adapted for movement between said first and second stops of said notch means.

* * * * *